United States Patent [19]

McAlister

[11] 3,980,061

[45] Sept. 14, 1976

[54] FUEL INJECTION-SPARK IGNITION SYSTEM FOR AN INTERNAL COMBUSTION ENGINE

[76] Inventor: Roy E. McAlister, 5285 Red Rock North, Phoenix, Ariz. 85018

[22] Filed: July 9, 1974

[21] Appl. No.: 486,910

Related U.S. Application Data

[62] Division of Ser. No. 232,575, March 7, 1972, Pat. No. 3,830,204.

[52] U.S. Cl. ..... 123/32 AE; 239/584

[51] Int. Cl.[2] ..... F02M 51/00

[58] Field of Search ..... 123/32 AE, 32 JV; 239/584, 585

[56] References Cited

UNITED STATES PATENTS

| | | | |
|---|---|---|---|
| 3,465,732 | 9/1969 | Kattehee | 123/32 AE |
| 3,501,099 | 3/1970 | Benson | 123/32 AE |
| 3,623,460 | 11/1971 | Komaroff et al. | 123/32 JV |

*Primary Examiner*—Wendell E. Burns
*Assistant Examiner*—David D. Reynolds
*Attorney, Agent, or Firm*—Cushman, Darby & Cushman

[57] ABSTRACT

A system of converting a carbureted-spark ignited internal combustion engine to a fuel-injection-spark ignited mode of operation comprising a series of fuel injecting spark plugs for replacing the conventional spark plugs, a fuel manifold for the spark plugs connected to the fuel line in lieu of its connection with the carburetor and a distributor assembly for replacing the distributor cap and rotor of the distributor having a shaft section fixedly connected to the rotor shaft of the distributor, the shaft section having a drum mounted thereon for rotation therewith and for axial movement therealong in response to the movement of the speed control mechanism of the engine (in lieu of the carburetor response thereof), the drum cooperating with a ganged structure in the form of a replacement distributor cap to generate electrical signals resulting from the rotational movement of the drum which are transmitted to the fuel injection plugs as a function of engine speed and are varied in time or other characteristic as a result of the axial movement of the drum as a function of speed control mechanism position. The system includes provision for the cut off of the fuel injection signals in response to the release of the speed control mechanism to its idle position until the engine speed reduces to a value just above idle speed and a start up of the fuel injection signals in response to a depression of the speed control mechanism before reaching the aforesaid speed which closely correspond to the actual engine speed, by retarding or damping the return axial movement of the drum.

2 Claims, 6 Drawing Figures

FUEL INJECTION-SPARK IGNITION SYSTEM FOR AN INTERNAL COMBUSTION ENGINE

This is a division of application Ser. No. 232,575 filed Mar. 7, 1972, now U.S. Pat. No. 3,830,204.

This invention relates to a system for converting conventional carbureted and spark ignited engines to fuel injected and spark ignited engines.

There are many systems proposed in the patented literature for rendering internal combustion engines capable of operation in a fuel injection and spark ignited mode. In general, these systems have employed elaborated electronic circuits for generating the electrical signals necessary for actuating the fuel injecting mechanisms so that a proper amount of fuel at the proper time is discharged into each combustion chamber. Many of these systems discharging directly into the combustion chamber which eliminates the need to provide fuel openings in the engine block.

Despite the disclosed capabilities of known fuel injection-spark ignition systems, in general, these systems have not been adopted to any appreciable extent particularly as conversion packages. Those systems which have been commercially adopted utilize complex electronic circuitry involving sensors for a great variety of varying engine conditions. As a consequence these sophisticated electronic systems have been suitable only as original equipment (as distinguished from conversion systems) where the relatively high costs involved can be included as a part of the greater overall costs of production, as with an automobile or the like.

The present invention is based upon the underlying principle that the costs heretofore encountered can be substantially reduced to a point where a conversion package is economically practical by varying the electrical injection signal as a simple function of the engine rotational speed and the position of the speed control mechanism. Thus, the system of the present invention utilizes two simple physically cooperating structures mounted for relative rotational movement of one with respect to the other and for relative movement with respect to each other between first and second positions and simply coupling the one structure to a rotating element of the engine so that its rotation is at all times a function of engine speed and interconnecting the speed control linkage between the two structures so that they will assume a relative position which is a function of the position of the speed control mechanism. The rotating structure then provides means for generating an electrical injection signal during each cycle of engine operation and change in relative position between the two structures provides means for varying a characteristic of the electrical injection signal by which the amount and timing of the fuel injection can be determined.

Accordingly, it is an object of the present invention to provide a system of fuel injection-spark ignition for an internal combustion engine embodying the principles set forth above so as to obtain the advantages stated and overcome the stated disadvantages of the prior art systems.

Another object of the present invention is the provision of a system of the type described which is constructed as a conversion package for existing internal combustion engines of the carbureted-spark ignition type capable of easy installation by simply replacing the existing distributor cap and spark plugs and disconnecting the fuel line and speed control mechanism from the existing carburetor and effecting connection thereof with components of the present system.

Another object of the present invention is the provision of a system of the type described which is particularly suited to be utilized with a variety of different fuels, such as gasolene (both high and low octane), diesel fuel, methane, propane, methanol, hydrogen, heated kerosene and the like.

A known advantage of fuel injection systems is that they can be made so as to cut off the injection of fuel during deceleration. Such cut-off materially aids in fuel conservation and reduces pollution. The present system is ideally suited to incorporation of the cut-off feature since cut-off is best determined as a function of engine speed and the position of the speed control mechanism. Moreover, in accordance with the principles of the present invention, a smoothly operating cut-off function is obtained by the provision of a damped override to the relative movement between the two structures in a direction corresponding to deceleration so as to limit the rate of deceleration under firing conditions and thereby encourage the operator to decelerate under a no-fire condition, as by completely releasing the accelerator pedal of the speed control mechanism.

Accordingly, it is an object of the present invention to provide a system of fuel injection embodying fuel cut-off during deceleration when the accelerator pedal is fully released and controlled rate deceleration in response to the release of the accelerator until the fully released position is reached.

Another object of the present invention is the provision of an improved fuel injection spark plug.

These and other objects of the present invention will become more apparent during the course of the following detailed description.

The invention may best be understood with reference to the accompanying drawings wherein illustrative embodiments are shown.

Figure 1:
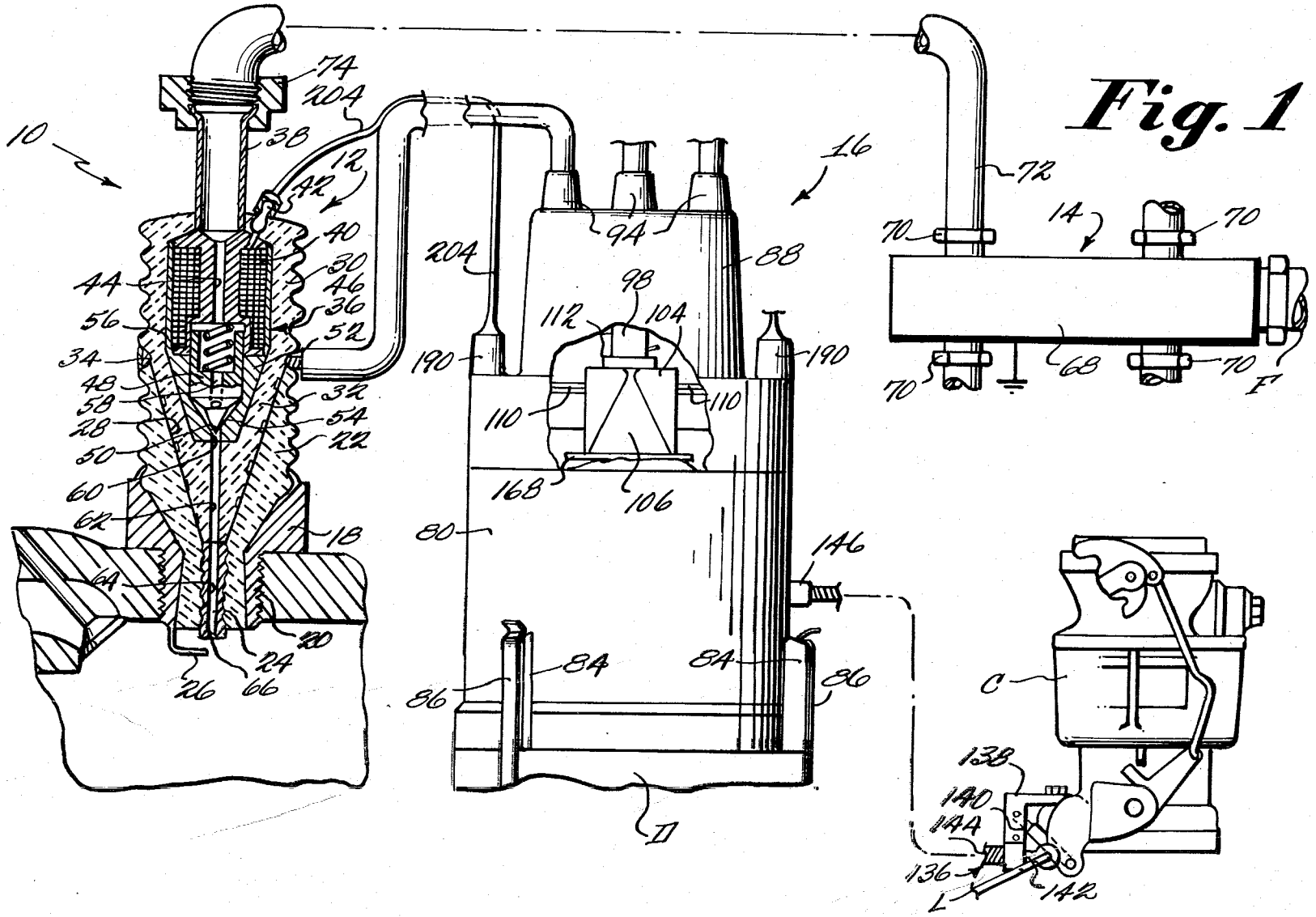
FIG. 1 is a somewhat schematic view illustrating a fuel injection-spark ignition system embodying the principles of the present invention installed as a conversion package on a conventional carbureted-spark ignited internal combustion engine of an automobile.

Referring now more particularly to the drawings, there is shown in FIG. 1 thereof a preferred form of fuel injection and the spark ignition system 10 for an internal combustion engine embodying the principles of the present invention. The system of the present invention is applicable to all known internal combustion engines either of the piston and cylinder type or of the rotary type, such as Wankel engines. The system is likewise applicable to engines which operate on the two cycle or four cycle mode. Since the system has particularly applicability as a conversion package for a conventional carbureted-spark ignited four cycle, piston and cylinder engine of the type used in most automotive vehicles today, FIG. 1 illustrates such exemplary application including those parts of a typical conventional engine which are effected by the conversion. These parts include a carburetor, indicated at C, having a linkage L of the speed control mechanism and a fuel line F of the fuel circuit connected therewith and a distributor D.

The system 10 includes a series of fuel injection spark plugs, generally indicated at 12, which are installed in the engine in place of the conventional spark plugs, a fuel line manifold or harness 14 having a fluid flow connection with the fuel line F in lieu of its connection with the carburetor C and a similar fluid flow connection with each spark plug 12, and a distributor cap replacement assembly, generally indicated at 16, which is adapted to be mounted on the distributor D in lieu of the conventional distributor cap thereof. The assembly 16 is adapted to be mechanically connected between the distributor rotor and its shaft and has a further mechanical connection with the linkage L of the speed control mechanism in lieu of its connection with the carburetor C. The assembly 16 also provides the conventional electrical connection between the spark igniting signal generating mechanism of the distributor D and the plugs 12 as well as an electrical connection therewith providing a fuel injection electrical signal.

In its broadest aspects, it will be understood that the present system 10 may utilize any known fuel injection spark plug construction. However, in FIG. 1 a preferred form of plug 12 is shown. The plug 12 includes the usual collar 18 of conductive material, such as metal or the like, the collar providing the usual exterior threads 20 on one end portion thereof for engagement with the engine block opening which receives the conventional spark plugs of the engine. Also, the collar 18 includes the usual exterior flats on its outer end portion which cooperate with a wrench or other tool for effecting the securement of the plug 12 in the engine block.

Mounted within the collar 18 is a first annular body 22 of insulative material, the body extending axially outwardly of the collar 18 and being fixedly secured therein by any suitable means, as for example, a swaged down lip on the outer end portion of the collar. The first annular body 22 has fixedly imbedded therein a concentric relation with the collar 18 an electrode member 24, the inner extremity of which is disposed in spaced relation to a ground electrode 26 formed on the inner extremity of the collar 18 so as to provide a spark gap between the two electrodes.

The outer end portion of the first annular body 22 is formed with a cavity or recess 28 extending from the exterior periphery intwardly into communication with the outer end of the electrode member 24. The plug 12 also includes a second annular body 30 of insulative material which is disposed in outward axially extending relation to the first body 22 and includes a projecting portion 32 adapted to engage within the cavity 28 of the first body 22. While this telescoping or male and female relationship between the first and second bodies may assume any particular configuration, as shown, the mating surfaces of the two bodies are of frustoconical configuration.

The two bodies 22 and 30 are arranged so as to be fused together along a portion of the mating frustoconical surfaces thereof with the remaining portion of the surfaces having a conductor 34 disposed therebetween for transmitting the high voltage required to generate the spark across the spark gap provided by the electrodes 24 and 26. In the embodiment shown, the conductor 34 is in the form of a helical strip having an exteriorly exposed annular portion adjacent the juncture of the exterior peripheries of the two bodies 22 and 30 and an inner end suitably connected to the adjacent end of the electrode member 24. It will be understood that the conductor 34 may assume other configurations as, for example, a frustoconical foil suitably apertured throughout to provide surface-to-surface contact permitting the two insulated bodies to be fused together during the assembly of the plug 12, as well as a straight rigid bar.

Preferably, the body 30 is molded in surrounding relation to a solenoid valve assembly, generally indicated at 36. The assembly 36 includes a first tubular member 38 having an outer end portion extending axially outwardly from the annular body 30 and constituting a fuel inlet for the plug 12. The inner end portion of the member 38 is in the form of a spool around which is wound a solenoid coil 40. One end of the solenoid coil is connected with the member 38 which is made of a conductive material and the opposite end thereof extends exteriorly through the spool end flange and the adjacent portion of the insulative body 30 and has an electrical connector 42 secured thereto.

The hub of the spool portion of the member 38 is provided with an axial passage 44 communicating the fuel inlet portion of the member 38 to a recessed opposite end thereof, indicated at 46. Mounted within the recess 46 is a solenoid plunger member 48, the outer end of which is formed into a valve element 50. The member 48 is slidably mounted within a second member 52 having an outer sleeve portion which encompasses the coil 40 and an inner portion which slidably receives the member 48 defining an annular valve seat 54 therein which cooperates with the valve element 50.

The member 48 is resiliently biased, as by a coil spring 56, into a position wherein the valve element 50 engages the valve seat 54 in closed relation therewith. The exterior periphery of the member may be provided with axial slots or the like which provide for flow of fluid from the passage 44 to the valve seat 54. In addition, as shown, the member 48 includes a central passage 58 which communicates with the exterior of the member at a position spaced from the valve element 50. The member 52 also provides an axial passage 60 leading from the valve seat 54 which in turn communicates with an aligned passage 62 formed in the body 30 and a passage 64 formed in the electrode member 24. The passage 64 terminates in a restricted orifice 66 calibrated so as to prevent flow of fluid outwardly thereof until a predetermined operating pressure condition is obtained.

The fuel manifold 14 may assume many different constructions, as shown, the manifold comprises a simple hollow elongated body 68 having an inlet connection at one end thereof for receiving the outlet end of the fuel line F disconnected from the carburetor C. The hollow body includes a plurality of outlet connections 70 of a number equal to the number of plugs 12 utilized in the system. In the embodiment shown in FIG. 4, an exemplary number of four outlets 70 is provided, each being connected as by a conduit 72 to the inlet portion 38 of a plug 12 as by a connecting nut 74 or the like.

Figure 2:
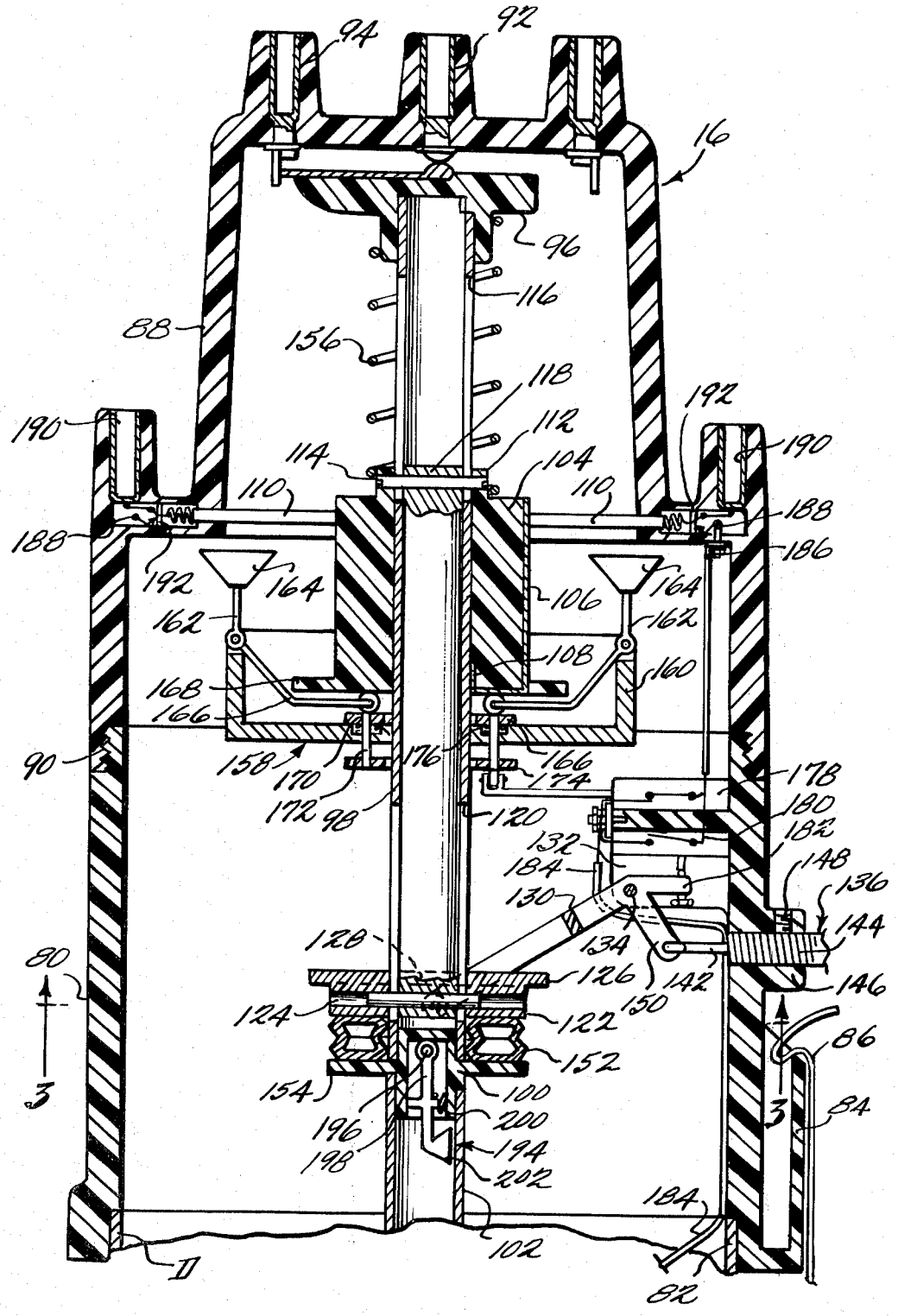
FIG. 2 is an enlarged vertical sectional view of a preferred embodiment of a distributor unit of the present system.

Referring now more particularly to FIG. 2, there is shown therein a preferred embodiment of the distributor assembly 16 mounted on the distributor D in place of the conventional distributor cap thereof. As shown, the assembly 16 includes a housing or distributor cap assembly including a lower adaptor section 80 having its lower end configured to engage the upper rim 82 of the distributor D in the same fashion as the normal distributor cap. In this regard, the adaptor section 80 includes lugs 84 for receiving the usual spring clips 86 which serve to detachably mount the conventional distributor cap onto the metal housing thereof. The housing assembly also includes an upper section 88 which is detachably mounted on the lower section 80, by any suitable means, such as a threaded connection 90 or the like. The upper section includes the usual central terminal 92 to which a lead from the coil is connected and a plurality of circumferentially spaced spark plug terminals 94. These terminals 92 and 94 are adapted to cooperate with a rotor 96 in the same manner as a conventional distributor. The assembly 16 includes a main hollow shaft section 98 having an adaptor 100 fixed to the lower end thereof which is configured to engage the upper end of the conventional rotor shaft 102 of the distributor D. The upper end of the main shaft section 98 is configured to detachably receive the rotor 96 in the usual fashion. It can thus be seen that the distributor assembly 16 of the present invention provides the same capabilities built into the conventional distributor insofar as the timing of the spark ignition is concerned.

In accordance with the principles of the present invention, a drum structure 104 is mounted over the shaft 98 for axial sliding movement with respect thereto and for rotational movement therewith. The drum 104 is preferably made of a plastic material and has embedded in the exterior periphery thereof a conductor sheet 106 having a generally wedge-shaped configuration as best shown in FIG. 1. The conductor sheet is electrically connected with the shaft 98, as indicated at 108, in FIG. 2 to provide a ground circuit therefor, as will be hereinafter more fully explained.

This conductor sheet 106 is adapted to cooperate with a plurality of radially extending electric contact brushes 110 carried by the upper cap section 88 in annually spaced position about the drum, the number of brushes provided corresponding with the number of plugs 12. The brushes 110 and the cap section 88 carrying the same constitute a structure which is disposed in physically cooperating relation with the drum structure 104 for rotational movement of one with respect to the other and for relative movement with respect to each other between first and second positions. Both the relative rotational movement and the relative movement between the first and second positions in the preferred embodiment shown is accomplished by the aforesaid axial and rotational movement of the drum structure 104.

While any suitable arrangement may be utilized to provide these movements, in the preferred embodiment shown, the drum structure 104 is formed with an axial flange 112 on its upper end through which a radial pin 114 extends. The pin 114 also engages within a pair of diametrically opposed axially extending slots 116 formed in the main hollow shaft 98 and a transverse bore within the upper end of a motion transmitting shaft or element 118, the lower end of which extends through the hollow shaft 48 to a position below the drum structure 104. The main shaft 98 is formed with a second pair of axially elongated slots 120 at a position adjacent the lower end portion of the motion transmitting shaft 118 and a collar 122 is slidably mounted in surrounding relation with the exterior of the main shaft 98 adjacent the lower extremity of shaft 118. A pin 124 similar to pin 114, extends radially through the collar 122, within the slots 120 and an appropriate bore in the adjacent lower end portion of the motion transmitting shaft 118.

With the above arrangement, it can be seen that the drum structure 104 will at all times rotate with the rotation of the rotor shaft 102 of the distributor D. The collar 122 provides a means whereby the drum structure 104 may be moved axially along the main shaft 98 during such rotation. This axial movement is effected as a function of the movement of the speed control mechanism of the automobile. To this end, the collar 122 includes an upper radially outwardly extending flange 126, the lower surface of which is adapted to be engaged by a pair of rollers 128 carried by the outer ends of a fork member 130. The fork member 130 is pivotally mounted on a lug structure 132 formed integrally on the interior of the lower cap section 80 at a position indicated at 134 in FIG. 2.

The motion of the speed control mechanism of the automobile is transmitted to the fork member 130 preferably by a conventional Bowden wire assembly, indicated generally at 136. With reference to FIG. 1, a bracket 138 is suitably mounted on the carburetor C and the normal throttle and choke mechanism of the carburetor is suitably locked into an open position as by any suitable means such as the turn-buckle link 140 illustrated in FIG. 1 extending between the bracket 138 and the throttle and choke mechanism. The connecting rod of the speed control linkage L is disconnected from the throttle and choke mechanism and connected to one end of a shaft 142 of the Bowden wire assembly 136. The Bowden wire assembly includes the usual flexible casing 144, the adjacent end of which is fixed to the bracket 138. The opposite end of the casing 144 is engaged within an apertured boss 146 formed in the lower cap section 80 and suitably fixed thereto by any suitable means, such as a set screw 148 or the like.

In the preferred embodiment shown in FIG. 2, the connection between the fork member 130 and collar 122 is a one-way connection by virtue of the provision of only a single upper flange 126. While it will be appreciated that it is within the contemplation of the present invention to provide a two-way lost motion connection between the fork member 130 and the collar 122 by utilizing a lower annular flange on the collar, the one-way connection shown is preferred because it provides for a smoother operation as will become more apparent hereinafter.

As can be seen from FIG. 2, in the normal idle position of the speed control mechanism, the rollers 128 of the fork member 130 are disposed slightly below the flange 126. This slight lost motion is provided for the purpose of limiting the idle position of the collar 122 by a pressure and temperature compensating means in the form of an annular bellows 152. As shown, the adaptor 100 includes an annular flange 154 extending radially outwardly therefrom and the annular bellows 152 is mounted between the annular flange 154 and the collar 122. The annular bellows thus serves as a limiting stop for the collar 122 which is both pressure and temperature sensitive.

The collar 122, shaft element 118 and drum structure 104 are resiliently biased into an idle position by a coil spring 156 surrounding the upper end portion of the main hollow shaft 98 and having its lower end engaged over the drum collar 112 and its upper end engaged over the attaching collar of the rotor 96. It can be seen that the return or downward axial movement of the drum 104 is effected by the spring 156. The force of this spring is calibrated to effect a controlled return movement of the drum in conjunction with the operation of a centrifugal retarding mechanism, generally indicated at 158. This mechanism includes a rotary member 160 of generally cupshaped configuration fixedly secured to the exterior periphery of the main shaft 98 by any suitable means, such as welding or the like. Carried by the upper outer periphery of the member 160 at equal annularly spaced positions thereabout is a plurality of pivoted levers 162 having weights 164 formed on one end thereof and rollers 166 journaled on the inner ends thereof. The upper surface of each of the rollers 166 is adapted to engage a lower flange 168 formed on the drum structure 104 and the lower surfaces thereof are adapted to engage the upper surface of a ring 170. The ring 170 has a plurality of annularly spaced pins extending downwardly therefrom through the member 160, the lower ends of the pins being in turn fixed within a lower ring 174. The two rings interconnected by the pins 172 are resiliently biased into an upper limiting position by a series of light springs 176 surrounding the pins 172 in a position between the upper ring 170 and the adjacent portion of the member 160.

The dual ring assembly provides a means for electrically sensing when the drum structure 104 is disposed within or adjacent to its idle position. To this end, there is provided a switch 178 having an arm mounted in a position to be engaged by the lower ring 174 when the drum structure 104 reaches a position closely adjacent its idle position. The switch 178 is adapted to be closed when the drum structure 104 is in its idle position or in any position closely adjacent thereto. This switch is connected in parallel with a switch 180 which is of the normally closed type adapted to be opened in response to movement of the speed control mechanism into a position adjacent its idle position. To this end, the fork member 130 is provided with a third actuating arm 182 which is disposed in a position to engage the plunger of the switch 180 and maintain the same in open condition when the speed control mechanism is either in its idle position or any position closely adjacent thereto.

As shown in FIG. 2, one side of the switches 178 and 180 is connected in parallel by a lead wire 184. The opposite end of the lead wire 184 is adapted to be connected in the circuit to the condensor and braker points of the distributor D at a position on the positive side of the condensor. The other poles of the switches 178 and 180 are connected in parallel with a lead terminal 186 which is connected to a circular conductor 188 mounted in the upper cap section 88. Connected between the circular conductor 188, each brush 110 and an associated terminal 190 is a transistor 192. Each transistor is connected so that the emitter is connected with the circular conductor 188, the collector is connected with the associated terminal 190 and the base is connected with the associated brush 110. Each transistor thus serves to complete a low voltage circuit to the associated terminal 190 when the associated brush 110 is grounded.

The grounding of each brush 110 is accomplished by the conductor sheet 106 on the drum structure 104 when the latter contacts the brush during the rotation of the drum structure 104. The ground circuit from the conductor sheet 106 is completed through the shaft 98 and to the distributor shaft 102 by a centrifugal switch assembly, generally indicated at 194. As shown, the switch assembly 194 includes a conductor shaft 196 which extends through the lower end of the shaft 198 and through the upper end of the adapter 100. The adapter is made of a suitable insulative material, such as plastic or the like, and is formed with a hollow interior within which a pendant conductor arm 198 is disposed. The conductor arm is connected with the shaft 196 and is biased into an open position, as by a spring 200 or the like. The arm includes an eccentric, weighted contact portion 202 which, when the shaft 102 is turned even at starter speeds moves out by centrifugal action into contact with the interior of the shaft 102 overcoming the bias of spring 200. Each terminal 190 is connected to the coil terminal 42 of an associated plug 12 by an appropriate lead 204.

OPERATION

It is believed apparent from the above description just how the component parts of the present system are mounted on a conventional automobile to convert the same to a fuel injection system. To briefly re-state these operations, the spark plugs of the conventional engine are replaced by a set of plugs 12, the fuel line F to the carburetor C is disconnected and connected to the fuel manifold 14. Each outlet 70 of the fuel manifold 14 is connected to the fuel inlet 38 of an associated plug 12 as by a line 72. Next, the linkage L of the speed control mechanism is disconneted from the throttle and choke mechanism of the carburetor C and this latter mechanism is locked into its fully open position by the turnbuckle 140 connected to bracket 138. The linkage L is then connected to one end of the Bowden wire assembly 136. Finally, the distributor cap of the engine is removed and replaced by the distributor assembly 16 of the present system. In this regard, it is assumed that the other end of the Bowden wire assembly 136 is connected to the fork member 130 and specifically the arm 150 thereof in the manner as shown in FIG. 2. Moreover, the lead wire 184 must initially be connected to the positive side of the condensor in the point circuit of the distributor D. In mounting the distributor assembly 16 on the distributor D, the adaptor 100 is engaged on the upper end of the output shaft 102 of the distributor in the same fashion as the conventional rotor. The spark ignition terminals 92 and 94 are connected respectively to the coil and plugs 12 in the usual fashion and the terminals 190 are connected to the coil terminals 42 of the plugs as by lines 204. By this simple interconnection, the present system renders a conventional carbureted spark-ignited engine capable of operating in a fuel injection-spark ignition mode.

The operation of the system 10 can best be explained in relation to the normal operation of an automobile. In this regard, it will be noted that since the fuel solenoid valve assemblies are connected in parallel with the spark ignition circuit, the latter will be under the control of the ignition key. When the operator turns on the key, the starter circuit is energized, causing a rotation of the engine which rotation moves the centrifugal switch assembly 194 into contact with the interior of the hollow distributor shaft 102 permitting the circuit through the conductor sheet 106 of the drum structure 104 to be completed. It will be noted that the drum structure 104 at start-up is disposed in its idle position as shown in FIG. 2, so that switch 178 is closed completing the circuit to the circular contact 188. As the drum structure 104 is rotated with the distributor shaft 102, the conductor sheet 106 will move into successive electrical contact with the brushes 110. This actuates the associated transistor completing the circuit to the associated terminal 190 and therefore through the coil 40 of the associated plug 12. The energization of the coil 40 draws the plunger member 48 upwardly, as shown in FIG. 1, against the normal bias of spring 56, moving the valve element 50 away from the seat 54, permitting fuel in the manifold assembly 14 to flow outwardly through passages 60, 62, 64 and restricted orifice 66 into the associated combustion chamber of the engine. The ignition signal is accomplished in the usual fashion through rotor 96 and the braker contact circuit of the conventional distributor D. In this way the plug 12 associated with each combustion chamber has a charge of fuel discharged therein and ignited by the spark during each cycle of operation.

Where the automobile has been standing in a cold environment or in a low-pressure environment prior to start-up, the bellows 152 will be contracted from the position shown in FIG. 2, thus causing the drum structure 104 to assume an idle position slightly below that illustrated in FIG. 2. As shown in FIG. 1, the conductor sheet 106 includes a diverging portion adjacent the apex position thereof at the upper end of the drum structure, thus providing for a fuel injection signal of a time duration slightly greater than the time duration at the normal idle position. Thus, the pressure and temperature sensitive annular bellows 152 serves as the equivalent of a choke and enables the system to provide for a greater idle speed than normally would be the case under low temperature and/or low pressure conditions. As soon as the engine has warmed up sufficiently, the bellows 152 will expand and thus limit the idle position of the drum structure 104 to the normal position shown in FIG. 2.

As the operator steps on the accelerator pedal and moves the same from its normal idle position toward its maximum acceleration position, this motion is transmitted through the linkage L and Bowden wire assembly 136 to the yoke member 130 which in turn moves collar 122 and hence drum structure 104 upwardly from the position shown in FIG. 2. This upward movement of the drum structure serves to increase the width of the contact strip 106 engaged by the brushes 110 during each revolution of the drum structure. This variation in turn serves to increase the time during which the coil 40 is energized and hence the amount of fuel discharged into each combustion chamber. Consequently, the engine speed will increase in response to the movement of the accelerator pedal toward its maximum acceleration position. The position of the leading edge of the conductor sheet provides an advance for the fuel injection signal, and in addition, the normal advance of the distributor shaft 102 is likewise utilized.

It will be noted that the movement of the yoke member 130 beyond a position slightly adjacent to the idle position shown will serve to close the switch 180 and as the speed of the engine increases beyond the idle speed, the weighted arm 162 of the centrifugal retarding assembly 158 will pivot about their axes so that the associated rollers 166 are moved in an upward direction generally following the upward movement of the drum structure 104. After a small predetermined amount of this movement, switch 178 is opened but since switch 180 has been previously closed, the circuit to the brushes 110 is continuously available. It can thus be seen that so long as the operator is moving the accelerator pedal in a direction toward maximum acceleration or maintaining the accelerator in any position to which it has been moved, the drum structure 104 will simply assume a corresponding position which determines the time of the fuel injection signal and hence the speed of the vehicle. This relationship in the preferred embodiment shown does not hold true, however, with respect to the movement of the accelerator pedal in a direction toward its idle position. When the operator rapidly releases his foot from the accelerator pedal, the yoke member 130 immediately returns to its idle position, thus opening switch 180. This has the effect of interrupting the circuit to the circular conductor 188 and hence no fuel injection signal will be transmitted to the plugs. In this way, a deceleration of the automobile will be effected with the engine being moved through its operation as a pump until the speed thereof slows down to a value adjacent idle speed, at which point switch 178 is closed, thus re-energizing the circuit to the fuel injection solenoids.

It will be noted that as the engine speed is reduced during the above-described operation, the movement of the drum downwardly is controlled by the centrifugal retarding assembly 58. Thus, as soon as the fork member 130 is moved into its idle position spring 158 adds its bias onto the drum structure 104, moving the latter downwardly. However, the calibration of the spring is such that this movement will be resisted by the position of the weights 164. As the speed is reduced the weights permit the spring to bias the drum structure downwardly until it reaches the position sufficient to close switch 178. In the event that the operator should engage the accelerator pedal before the engine speed reaches a value sufficient to close the switch 178, the movement of the accelerator pedal will permit reenergization of the fuel injection circuit by closing the switch 180. The retarding mechanism insures that when the switch 180 is closed, the initial signal transmitted to the plugs 12 will be at a value nearly that desired for the speed at which the engine is then operating. In this way a smoother operation is insured.

It will be appreciated that the operation of the present system will require a little getting used to by the operator. In any situation where the operator desires to bring the vehicle to a stop, the operator is required to release his foot from the accelerator pedal and the cut-off feature of the present system will materially aid in bringing the vehicle to the desired stop. The arrangement clearly conserves fuel and by the same token reduces pollution. As the engine speed approaches idle speed injection is automatically resumed at the desired idle speed. On the other hand, where it is desired to diminish the speed, as in cruising, the operator need only let off his foot slightly from the accelerator pedal and the speed retarding mechanism will provide a controlled retarding of the speed. Thus, a smooth cruising operation is insured.

Perhaps one of the greatest advantages of the present system is that it renders the automobile capable of operating on low octane gasoline and numerous other fuels. The system is essentially independent of variations in the manifold fuel pressure produced by the conventional fuel pump of the automobile, in that variations in the fuel pressure will be reflected equally in all of the cylinders so that the only compensation required by the operator is to vary the position of the accelerator pedal for a given desired speed in the event of a variation in fuel pressure. By injecting the fuel directly into the combustion chamber, the cut-off feature is made possible even with liquid fuels, since instantaneous response is possible. Where gasoline fuel injection occurs in the manifold, such instantaneous action can not be achieved, due to the wetting and drying of the manifold walls by the fuel. Moreover, by injecting the fuel directly into the combustion chamber, a more accurate timing of the fuel injection can be maintained, thus eliminating the need for high octane, and indeed rendering the present system capable of operating on all well-known fuels such as diesel fuel, methane, propane, heated kerosene and the like. The present system lends itself readily to a dual fuel capability as well. That is, a system which has the capability of alternately operating on any one of two or more different fuels.

It will be understood that while the simple conductor sheet and brush means for generating the electrical signal for effecting the fuel injection is preferred, the present system lends itself to other electric signal generating means. Such alternative means may include a primary transformer in the drum assembly, a magneto in the drum assembly or even a phototransistor in the drum assembly.

It will also be understood that while all of the above arrangements including the conductor sheet and brush arrangement vary the characteristic of the electric fuel injection signal in terms of time, the present system also contemplates varying other characteristics of the electrical signal. For example, in FIGS. 4–6, there is shown components of a modified system in which the characteristic of the electrical fuel injection signal which is varied is the voltage of the signal, the variation in the voltage being utilized to vary the amount of fuel injected.

Figure 4:
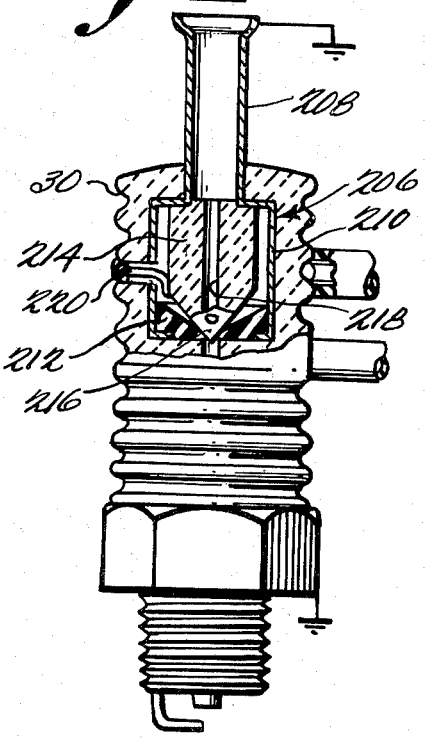
FIG. 4 is an elevational view partly in section illustrating a modified form of fuel injecting spark plug.

FIG. 4 illustrates the modifications in the fuel injection spark plug 12 necessary to make the plug responsive to an electrical signal which varies in voltage. The plug illustrated in FIG. 4 is identical with the plug 12 previously described except that the valve assembly 36 of the plug 12 is replaced by a different valve assembly, indicated generally at 206. Since the plug is the same except for this difference a description of the remaining structure of the plug is deemed unnecessary and corresponding reference numerals have been applied to FIG. 4. The assembly 206 includes an inlet tube portion 208 similar to the portion 38 previously described and an inner casing portion 210 having a valve seat member 212 of electrical insulative material carried by the inner end portion thereof. Fixed to the juncture between the inner and outer portions 208 and 210 is the outer end of a valve member 214 made of a piezoelectric material. The valve member 214 extends inwardly toward the valve seat member 212 and has a valve surface 216 formed on the inner end thereof which is normally disposed in closing engagement with the valve seat.

As before, the valve member 214 may include an axial passage 218 extending inwardly from the outer end thereof which communicates exteriorly of the member at a position spaced outwardly of the valve surface 216 thereof. The exterior periphery of the body 30 has a lead 220 extending annularly thereabout and radially therethrough and through the adjacent portion of the casing 210, the lead being electrically connected to the inner end of the valve member 214. The valve member 214 may be of any conventional piezoelectric material of the type which will contract in length in response to the transmission of a high voltage current therethrough, as by a circuit from the lead 220 to ground through the inlet tube 208, with the amount of contraction being proportional to the voltage of the electrical signal transmitted thereto.

Figure 5:
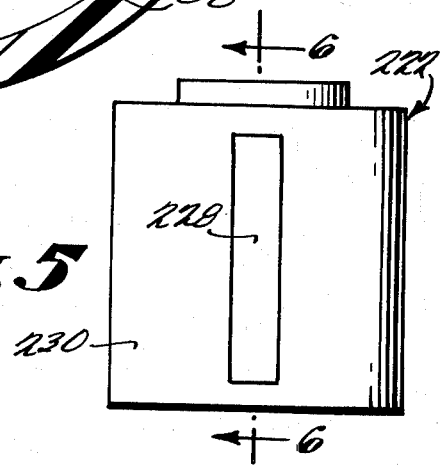
FIG. 5 is an elevational view of a drum structure of modified form.
Figure 6:
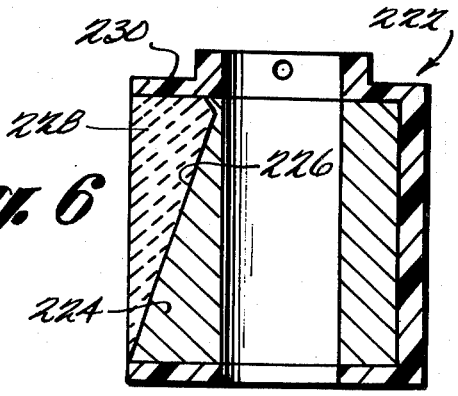
FIG. 6 is a sectional view taken along the line 6—6 of FIG. 5.

FIGS. 5 and 6 illustrate a drum structure, generally indicated at 222, for generating the variable voltage signal to which the valve assembly 206 is responsive. It will be understood that this drum structure 222 can be simply substituted in lieu of the drum structure 104 previously described. As best shown in FIG. 6, the drum structure 222 includes a core 224 of conductive material, such as metal or the like, having an axially bore therein for receiving the shaft section 98. This core includes an axially extending slot 226 which varies in depth throughout its axial extent. Mounted within the slot 226 is a variable thickness resistor 228 which is made of any conventional resistor material. The outer surface of the resistor 228 extends beyond the outer periphery of the core 224 in flush relation to the outer cylindrical surface of a cover 230 made of electrical insulative material, such as plastic or the like.

Figure 3:
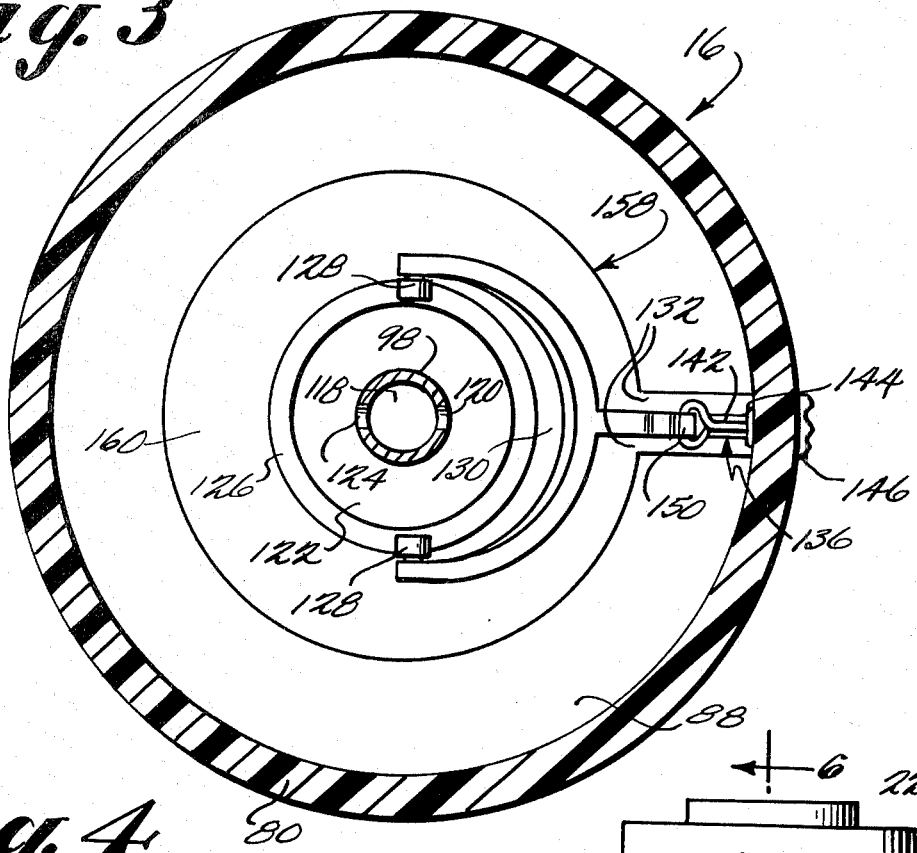
FIG. 3 is a sectional view taken along the line 3—3 of FIG. 2.

It will be understood that the axial movement of the drum from an idle position toward a maximum acceleration will result in a decreasing of the resistance of the circuit through the variable resistor 228 and hence an increasing voltage in the electrical fuel injection signal transmitted to the piezoelectric valve member 214. Since the valve member 214 contracts an amount which increases proportional to the increase in the voltage the amount of fuel discharged increases due to the greater flow passage through the valve seat or lesser resistance to flow therethrough. It will be understood that the electrical characteristics of the transistors 192 utilized in the circuit for transmitting the variable voltage signals to the valve members 214 may be appropriately modified from those used in connection with the preferred embodiment of FIGS. 1–3 to enable the transmission of the high voltages required to effect contraction of the piezoelectric material of the valve members 214. If necessary amplifiers may be embodied in each transistor circuit.

It can thus be seen that there has been provided a system which is simple in structure and operation. This simplicity is obtained by the basic provision of two physically cooperating structures mounted so that one rotates with respect to the other and so that a relative movement with respect to each other between limiting position can take place during such rotation. It will be noted that in the preferred embodiment shown, one of the structures is a ganged structure suitable to accommodate a plurality of combustion chambers of the piston and cylinder type. It is preferable that the ganged structure be generally stationarily mounted and that the rotating structure be moved axially to accomplish the relative movement as exemplified by the preferred embodiments shown in the drawings and described above. In its broader aspects however, the present invention contemplates movement of the ganged structure so long as the principles of the invention are adhered to.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

I claim:

1. A device for injecting fuel into a combustion chamber of an internal combustion engine comprising a structure adapted to be mounted in an internal combustion engine with one portion thereof disposed in operative communicating relation with a combustion chamber and another disposed in generally exposed relation, said structure having fuel passage means extending therethrough having inlet means in said exposed portion and outlet means in said one portion, and valve means of piezoelectric material normally closing said passage means operable in response to the transmittal of a variable characteristic electrical signal thereto to open said passage means a variable amount which varies the flow rate therethrough as a function of the variable characteristic of said electrical signal, said valve means including a rigid valve housing and an elongated valve member of piezoelectrical material, said elongated member having one end thereof fixed to said housing and the opposite end thereof disposed in normally closing relation to said passage means, and means for electrically connecting the ends of said piezoelectrical member for transmittal of a variable characteristic electrical signal therethrough whereby the opposite end of said piezoelectrical member moves longitudinally away from said passage means a variable amount which is a function of the variation in said variable characteristic electrical signal.

2. A device for injecting fuel into a combustion chamber of an internal combustion engine comprising a structure adapted to be mounted in an internal combustion engine with one portion thereof disposed in operative communicating relation with a combustion chamber and another disposed in generally exposed relation, said structure having fuel passage means extending therethrough having inlet means in said exposed portion and outlet means in said one portion, and valve means of piezoelectric material normally closing said passage means operable in response to the transmittal of a variable characteristic electrical signal thereto to open said passage means enabling fuel to flow through said passage means and out of said outlet means in a variable amount which is a function of the variation in said variable characteristic electrical signal, said valve means including a rigid valve housing and an elongated valve member of piezoelectrical material, said elongated member having one end thereof fixed to said housing and the opposite end thereof disposed in normally closing relation to said passage means, and means for electrically connecting the ends of said piezoelectrical member for transmittal of a variable characteristic electrical signal therethrough whereby the opposite end of said peizoelectrical member moves longitudinally away from said passage means a variable amount which is a function of the variation in said variable characteristic electrical signal.

* * * * *